United States Patent [19]

Isshiki

[11] Patent Number: 4,980,940

[45] Date of Patent: Jan. 1, 1991

[54] CORE MATERIAL FOR BED AND BED MADE THEREFROM

[76] Inventor: Tadao Isshiki, 8-12, Honjoh 3-chome, Yakeyama, Kure-shi, Japan

[21] Appl. No.: 451,859

[22] Filed: Dec. 18, 1989

[51] Int. Cl.[5] ..... A47C 27/14; A47C 27/00; A61G 7/057

[52] U.S. Cl. ..... 5/468; 5/425; 5/481; 5/448

[58] Field of Search ..... 5/468, 481, 469, 425, 5/448, 464; 297/DIG. 1

[56] References Cited

U.S. PATENT DOCUMENTS

| | | | |
|---|---|---|---|
| 3,209,380 | 10/1965 | Watsky | 5/468 |
| 3,331,089 | 7/1967 | Ornas, Jr. et al. | 5/468 |
| 3,803,646 | 4/1974 | Newerowski | 5/93 R |
| 3,974,532 | 8/1976 | Ecchuya | 5/468 |
| 4,070,719 | 1/1978 | Morgan | 5/468 |
| 4,286,344 | 9/1981 | Ikeda | 5/425 |
| 4,547,920 | 10/1985 | Hulsebusch et al. | 5/468 |

FOREIGN PATENT DOCUMENTS

| | | | |
|---|---|---|---|
| 3017379 | 11/1981 | Fed. Rep. of Germany | 5/468 |
| 3321720 | 12/1984 | Fed. Rep. of Germany | 5/481 |
| 1090785 | 4/1955 | France | 5/468 |
| 9028916 | 8/1982 | Japan | 5/482 |

*Primary Examiner*—Alexander Grosz

*Attorney, Agent, or Firm*—Armstrong, Nikaido, Marmelstein, Kubovcik & Murray

[57] ABSTRACT

A core material for bed comprising a mat portion made of molded synthetic resin foam having a multiplicity of concavo-convexities in its surface and a supporting base portion also made of molded synthetic resin foam and disposed under said mat portion and having a multiplicity of vertical cutouts therein. Also disclosed is a bed comprised of the core material, the surface of which is decorated. The bed of the present invention is very light and has a proper cushioning property and thus it is not only easy to move and handle, but also it has no risk of damaging a floor, carpet, etc., and further, no risk of suffering any injury from stumbling over or hitting against it.

10 Claims, 2 Drawing Sheets

CORE MATERIAL FOR BED AND BED MADE THEREFROM

BACKGROUND OF THE INVENTION

1. Field of the Invention

The present invention relates to a core material for a bed and a bed made by using it and, more particularly, to a core material for bed and a bed made by using it, being light in weight and, therefore easy to remove or handle, having no risk of injuring the floor and also being effective for maintaining or even improving health by a finger-pressure therapy-like effect produced by a proper cushioning effect and a concavo-convex surface of the material.

2. Description of the Prior Art

Hitherto, commonly used beds were made of wood or metal. A metal or wooden bed is so heavy that it is difficult to move for cleaning or rearrangement and may cause serious injury if one should stumble over such a bed. Also a heavy bed, when it is used for a long time, tends to form a "bed mark" on the surface of floor or carpet. When the bed is moved a short distance, it is often dragged on the floor or carpet, and this action may badly injure the floor or carpet.

SUMMARY OF THE INVENTION

It is an object of the present invention to provide a core material for bed and a bed made from the core material which solves the drawbacks of the conventional beds.

Other objects and advantages of the present invention will be apparent from the following detailed description.

The present inventor, after intensive study, discovered that by making a bed with a molded synthetic resin foam having its surface made concavo convex, not only overcomes problems regarding the weight and mobility of the bed or inconvenience due to the risk of injury, damage to the floor and the like, but also because of a finger-pressure therapy-like effect produced by the concavo-convexities in the surface of the foam enhances blood circulation, resulting in maintenance and even improvement of health.

DETAILED DESCRIPTION OF THE INVENTION

Figure 1:
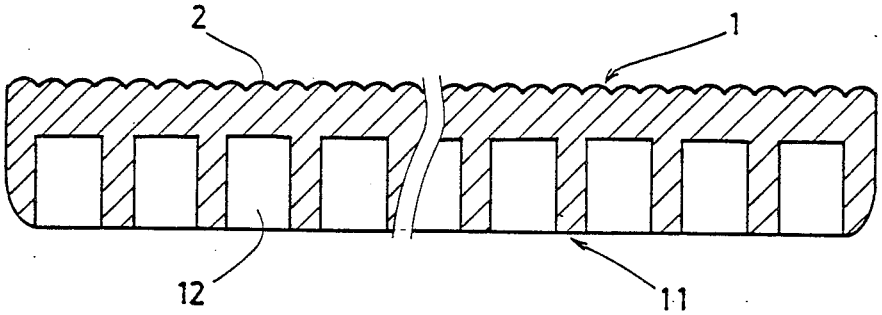
FIGS. 1 through 3 are schematic sectional views showing embodiments of the core material for the bed of the present invention respectively.

The present invention relates, in one aspect, to a core material for a bed comprising a mat portion made of molded synthetic resin foam having a multiplicity of concavo-convexities and a supporting bed portion also made of a molded synthetic resin foam disposed under the mat portion and having a large number of vertical cutouts therein.

The present invention also relates to a bed comprising a core material for a bed, comprising, a mat portion made of molded synthetic resin foam having a multiplicity of concavo-convexities in its surface and a supporting base portion also made of molded synthetic resin foam and having a multiplicity of vertical cutouts therein, which is decorated by converting or bonding to it a woven fabric, nonwoven fabric, leather, synthetic leather, or by flocking, or by coating with a paint or pigment.

The molded synthetic resin foam used in the present invention includes polyolefin type resins such as polyethylene, polypropylene and copolymer resins, polyurethane type resins, polystyrene type resins and the like. Preferably polyolefin type resins are used, which possess proper cushioning property and rigidity.

The mat portion of the present invention has a multiplicity of concavo-convexities in its surface, but there is no particular limitation regarding the degree of concavo-convexity so long as a finger-pressure therapy-like effect is attainable. Preferable such an effect is created with sheets having swollen portions, randomly or regularly arranged wavy sheets, or sheets in which semi-circular arcs in section are made. The size, height and distribution density et cetera of swollen portions, wave forms or semi-circular arcs may be properly determined according to the desired degree of finger-pressure therapy-like effect. If a swollen portion, wave form or semi-circular arc are constructed to be considerably larger, it is possible to provide small projections in the vicinity of the apex thereof to thereby attain a compound finger-pressure therapy-like effect. Such an effect is achieved by a combination of a mild finger pressure therapy-like effect due to the large swollen portion, wave form or semi-circular arc and a sharp finger pressure therapy-like effect due to the small projection.

The supporting bed portion of the present invention is disposed under the aforementioned mat portion to hold the mat portion at a proper height above floor level. The supporting bed portion has a multiplicity of vertical cutouts therein. The cutouts are provided primarily for weight-saving and improved air permeability and is economical from a stand point of saving material. There is no particular limitation regarding the size and number of cutouts so long as the supporting base portion has enough strength to support the load of the mat portion as well as a body lying thereon.

The surrounding four sides or edges of the supporting base portion may be raised above the surface of the mat portion. This raised edge portion may be present in any part of the four surrounding sides of the supporting base portion. For instance, the raised edge portion may be present one side or on opposing longitudinal sides, two widthwise sides or on all four sides. The proper height of the raised edge portion depends on the linen or other bedding placed on the surface of the mat portion, for instance, sheet, blanket or bedquilt. However, the height of the raised edge portion ranges from several cm to 20 cm or so. Such raised edges can prevent slipping or loss of a bedquilt or blanket. It is, needless to say, possible to provide a headboard.

Since the mat portion of the present invention has a concavo-convex surface, the concave portion functions as a ventilation channel to keep the bed dry and always clean by diffusing sweat or waste away from a sleeping person. However, additional ventilation holes may be provided in the mat portion. In this case it is preferred to provide ventilation holes in the concave portions to communicate with the cutouts in the supporting base portion. The ventilation holes ensure good air permeability to the exterior of the surface of the mat portion. The cutouts provided in the supporting base portion together with the ventilation channels in the concave portions in the surface of the mat portion, together, provide ventilation in the vertical and horizontal directions and the bed can be kept still cleaner. Ventilation holes may also be provided in the raised edge portions.

It is possible to mold the mat portion and the supporting base portion separately and then join the two portions with an adhesive or the like, but this joining step can be dispensed with if both portions are molded by expansion molding in a mold, in which expandable resin particles fill a mold and are heated to fusion by means of steam and the like. In this case, the mat portion and the supporting base portion may be divided in two or three longitudinal sections enabling reduction in mold size facilitating the molding process. Further, this method of dividing the mat portion and the supporting base portion into two or three longitudinal sections facilitates handling of the units, which may be easily and compactly stored in a warehouse or the like. Furthermore, during the day when the bed is not needed, the constituent units can be used as sofas. It is advisable to make the constituent units connectable and disconnectable by means of joiners, magnets, face fasteners or the like.

The surfaces of core material for the bed made up of the mat portion and the supporting portion is finished like a bed with surface ornamentation. Ornamentation may be provided by any known means such as covering with a woven or nonwoven fabric, leather, synthetic leather or the like, bonding, flocking, and coloring with a paint or pigment or the like. When a woven or nonwoven fabric is used, it is convenient to have the woven or nonwoven fabric of some thermoplastic fiber affixed to the inside of the mold used, filling in the mold with expandable particles of, for example, a polyolefin type resin and then heating with steam for expansion molding. Alternatively, molding may be conducted by heating the mold filled with expandable particles to give a molded foam, and then setting in the mold a woven or nonwoven-fabric with which the molded foam is covered, thereafter heating the assembly with steam for integration of the two.

According to the present invention, it is also possible to supply to or affix to a molded synthetic resin foam a functional ceramic powder having one or more of the following effects: far infrared ray emitting effect, an anti-bacterial effect, an insecticidal effect, deodorizing effect and the like.

In recent years, far infrared rays have been found to be effective for enhancing blood circulation, restoration of fatigue of muscles as well as easing of neuralgia or muscular pain, activation of gastroenteric function and the like. Further, it is known that certain ceramics possess an anti-bacterial effect, insecticidal effect, deodorizing effect, etc. Such ceramics, include SERAARBUS (trade name of Osaka Cement Co., Ltd) and other known ceramics of metal oxide type as well as those made by flame spray coating a metal surface with metal oxides. As a method of incorporating a functional ceramic in a molded synthetic resin foam, a known easy method, for instance, includes mixing a functional ceramic in fine powder form, with a synthetic resin such as polyolefin and then pelletizing the mixture with an extruder.

Having the ceramic affixed to the surface of a molded foam may, for instance be accomplished by mixing a given ceramic in a solvent containing a binder resin and then coating the molded foam therewith and drying. The pulverized functional ceramic should be as fine as possible, preferably not greater than 500 $\mu$m and, more preferably not greater than 100 $\mu$m.

Such a functional ceramic may also be contained or affixed to the material used for decoration such as a woven or nonwoven fabric or fibers used for flocking. For instance, when the fabric is a melt-spun fiber, such as polyamide or polyester fiber, a method for uniformly dispersing a given functional ceramic in the molten polymer before extruding into air, a gas or a liquid can be conducted. In the case of dry spinning of acetate rayon, ORLON (Registered trademark owned by Dupont) or the like, it is possible to first dissolve the polymer in a proper solvent and then, after dispersing a given functional ceramic uniformly therein, extruding the dispersion into hot air for removal of the solvent so that the polymer is solidified in fiber form. In the case of wet spinning of viscose rayon, vinylon (polyvinyl alcohol fiber) or the like, it is possible to first disperse a functional ceramic in a given polymer solution and then extrude it into a coagulation bath for solidification in fiber form. When a solvent is used for dissolving a polymer it is possible to have the ceramic predispersed in a portion of the solvent before adding it to the polymer solution and it is thereby possible to have the ceramic more uniformly dispersed in the fiber. In the case of a paint or pigment, a ceramic in fine powder form may be added alone or in combination with a solvent, and in the case of a synthetic leather it may be mixed in the material synthetic resin. In the case of a natural leather, it may be coated and dried by the aforementioned method.

Furthermore, together with the ceramic, other materials such as far infrared ray reflective materials like aluminum powder, etc. may be added in fine powder form. In such a case, the far infrared rays are thrown back by the reflective effect of the reflective material and the utilization efficiency of the far infrared rays is further improved.

As mentioned above, when the ceramic is contained or affixed to either or both the decorative material and the molded synthetic resin form, the far infrared rays are irradiated from the ceramic by the heat emitted from the human body and the effects of far infrared rays include a therapeutic effect, anti-bacterial effect, insecticidal effect and deodorizing effect, all produced naturally. All of these effects occur without the user of the bed realizing them. When a far infrared ray reflective material in powder form is used in combination with the aforementioned ceramic, the emitted infrared rays are thrown back toward the human body side and their effect can be obtained more efficiently.

The present invention is described in greater detail with reference to the accompanying drawings.

FIG. 1 is a schematic sectional view of a core material for a bed made up of a mat portion (1) and a supporting base portion (11). The mat portion (1) is provided on its surface with wavy concavo-convexities and the supporting base portion (11) has cutouts (12) therein. In this structure, the convex portions of the wavy concavo convex surface exhibit a finger-pressure therapy-like effect and the concave or trough-like portions function as ventilation channels.

Figure 2:
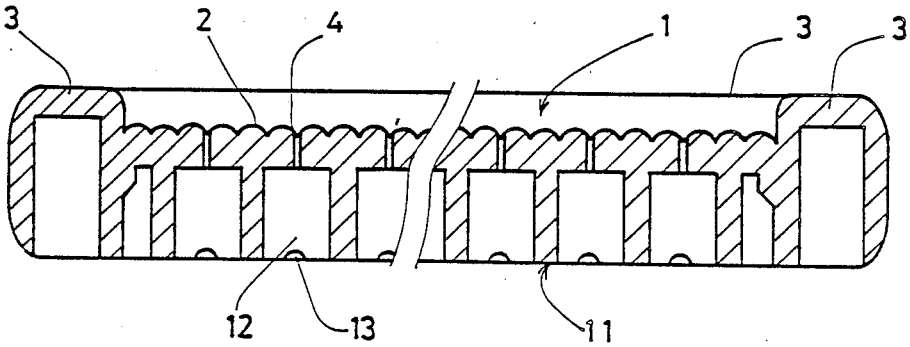

FIG. 2 shows another embodiment of the present invention, wherein the core material for a bed is made up of the mat portion (1) and the supporting base portion (11). The mat portion has on it surfaces wavy concavo-convexities (2); the concave or trough-like portions of the wavy concavo-convexities (2) have vertical air ventilation holes (4) communicating with the cutouts (12) provided in the supporting base portion (11) and there is provided raised edge portions (3) on surrounding sides of the mat portion. Also shown are horizontal ventilation holes (13) in communication with the cutouts (12) to ensure ventilation between the inside and outside of the cutouts (12). In this structure, ventilation in the vertical direction can be ensured by means of the vertical ventilation holes (4), cutouts (12) and horizontal ventilation holes (13).

Figure 3:
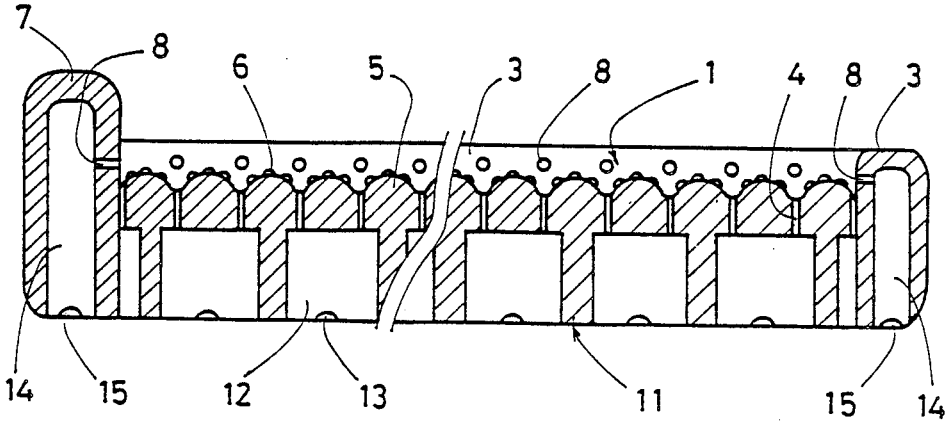

FIG. 3 shows still another embodiment of the present invention, wherein the mat portion (1) has on its surface a continuous semi-circular concavo-convexities (5). Thumb tip-sized small projections (6) are provided in the vicinities of the apex of the semi-circular convex portions, and in the concave portion between the adjacent convex portions there is provided vertical ventilation holes (4) communicating with the cutouts (12) in the supporting base portion (11). The mat portion is surrounded by the raised edge portions (3) on three sides thereof and a headboard (7) is provided on the remaining one side. The raised edge portions (3) and the headboard (7) have cutouts (14) provided therein as well as sideway ventilation holes (8) communicating with the cutouts (14). The cutouts (12) and (14) are also provided with horizontal ventilation holes (13) and (15) communicating therewith. In this structure, there is obtained a wide, mild finger-pressure therapy-like effect by the convex portion of the semi-circular concavo-convexities (5) in combination with a local, sharp finger-pressure therapy-like effect generated by each small projection (6) provided in the vicinities of the apex of the semi-circular convex portion. Ventilation is achieved through the concave or trough-like portion between the adjacent semi-circular convex portions, ventilation holes (8), cutouts (14) and the horizontal ventilation holes (15) as well through the vertical ventilation holes (4), the cutouts (12) and the horizontal ventilation holes (13). By this ventilation system the bed is kept in an extremely dry and clean state.

Figure 4:
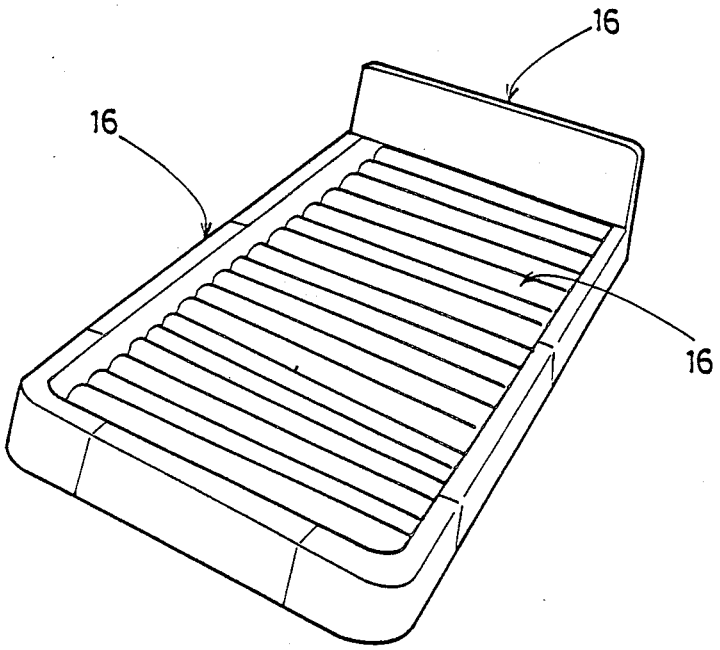
FIG. 4 is a schematic view showing an embodiment of a bed of the present invention.

FIG. 4 is a schematic, perspective view showing a bed made by the use of the core material for bed of the present invention which is decorated with a woven fabric (16).

As mentioned above, the core material for bed of the present invention and a bed made by the use thereof exhibits the following features and advantages:

(1) It is light and has a proper cushioning property; the bed forms no mark even when it is placed on a carpet, and it can be dragged without the risk of injuring the floor or carpet.

(2) It has a proper cushioning property as well as light weight, there is no risk of suffering any injury from stumbling over or hitting against it.

(3) The bed is easy to move for cleaning or rearrangement. It is also easy to dry the bed in the daylight.

(4) The concavo-convex surface with its finger-pressure therapy-like effect enhances blood circulation, which relieves stiffness in the shoulders or muscular pain, thus the device maintains and improves health during sleeping.

(5) The bed having good horizontal and/or vertical ventilation allows diffusion of sweat or waste during sleeping, hence it remains dry and clean.

(6) When a ceramic is contained or affixed to the molded synthetic resin foam or in the material used for decoration, far infrared rays are emitted for enhancement of blood circulation, restoration of muscular and/or bodily fatigue and the like during sleep. The bed is always clean, in part because of the ability of the far-infrared rays to produce an anti-bacterial, insecticidal or deodorizing effect.

(7) The bed or the present invention maintains and improves health during sleeping and is well ventilated, dry and clean, hence, the bed can be used by healthy persons and ill or bedridden persons, being effective for preventing bedsores.

What is claimed is:

1. A core material for a bed comprising a mat portion made of a continuous molded synthetic resin foam having a plurality of ridges, each ridge having a longitudinal axis, and each longitudinal axis being perpendicular to the longitudinal axis of the mat or perpendicular to the direction of a sleeping body, and a supporting base portion disposed under said mat portion made of molded synthetic resin foam having a plurality of vertical cutouts therein and having on at least one side thereof a raised edge portion extending above the mat portion, said raised edge portion having ventilation holes.

2. A core material for bed according to claim 1, wherein there are provided ventilation holes in the mat portion communicating with the cutouts in the supporting base portion.

3. A core material for a bed according to claim 1, wherein the mat portion and the supporting base portion are an integral unit created by expansion molding the mat and base portion in a mold.

4. A core material for bed according to claim 1, wherein the molded synthetic resin foam is of a polyolefin type resin.

5. A core material for a bed according to claim 1 wherein a ceramic fine powder which radiates far infrared rays is incorporated in the molded synthetic resin foam to produce at least one of the following effects: antibacterial, insecticidal and deodorizing effects.

6. A bed comprising a mat portion made of a continuous molded synthetic resin foam, the mat surface having a plurality of ridges, each ridge having a longitudinal axis and each longitudinal axis being perpendicular to the longitudinal axis of the bed or to the direction of a sleeping body, and a supporting base portion disposed under said mat portion also made of molded synthetic resin foam having a plurality of vertical cutouts, therein, and having on at least one side thereof a raised edge portion extending above the mat portion, said raised edge portion having ventilation holes, and a surface of the bed is decorated by a covering selected from the group consisting of a woven fabric, a nonwoven fabric, leather, synthetic leather, paint and pigment.

7. A bed according to claim 6, wherein the covering contains or has affixed thereto a functional ceramic fine powder which radiates far infrared rays.

8. A core material for a bed comprising a mat portion made of molded synthetic resin foam having a plurality of ridges and a plurality of troughs which separate said ridges, each ridge having a longitudinal axis, and each longitudinal axis being perpendicular to the longitudinal axis of the mat, or perpendicular to the direction of a sleeping body, and a supporting base portion made of a molded synthetic resin foam having a plurality of cutouts therein, and having on at least one side thereof a raised edge portion extending above the mat portion, said raised edge portion having ventilation holes;

said cutouts within the base portion communicating with vertical ventilation holes on the surface of the mat portion.

9. The core material of claim 8 wherein said vertical ventilation holes are seated within the troughs of the mat portion.

10. The core material of claim 8 further comprising horizontal ventilation holes in said base portion and in communication with said vertical cutouts.

* * * * *

UNITED STATES PATENT AND TRADEMARK OFFICE

CERTIFICATE OF CORRECTION

PATENT NO. : 4,980,940

DATED : January 1, 1991

INVENTOR(S) : Tadao ISSHIKI

It is certified that error appears in the above-identified patent and that said Letters Patent is hereby corrected as shown below:

On the cover page, after Item [22], the following should appear:

-- [30] Foreign Application Priority Data
November 27, 1989 [JP] Japan .....1-308199--.

Signed and Sealed this

Twelfth Day of May, 1992

*Attest:*

DOUGLAS B. COMER

*Attesting Officer*

*Acting Commissioner of Patents and Trademarks*